US006397823B1

(12) United States Patent
Mammarella

(10) Patent No.: US 6,397,823 B1
(45) Date of Patent: Jun. 4, 2002

(54) PURGE VALVE INTEGRATION

(75) Inventor: John Ronald Mammarella, Windsor (CA)

(73) Assignee: Siemens Canada Limited, Tilbury (CA)

( * ) Notice: Subject to any disclaimer, the term of this patent is extended or adjusted under 35 U.S.C. 154(b) by 0 days.

(21) Appl. No.: 09/684,303

(22) Filed: Oct. 6, 2000

Related U.S. Application Data

(60) Provisional application No. 60/158,093, filed on Oct. 7, 1999.

(51) Int. Cl.[7] ..... F02M 37/04

(52) U.S. Cl. ..... 123/516; 123/518; 123/184.2

(58) Field of Search ..... 123/456, 518, 123/519, 516, 520, 184.21, 184.54, 184.61

(56) References Cited

U.S. PATENT DOCUMENTS 5,642,698 A * 7/1997 Diehl et al. ..... 123/184.21
5,701,874 A 12/1997 Sari et al.
5,743,235 A * 4/1998 Lueder ..... 123/468
5,857,446 A 1/1999 Norton
5,996,559 A 12/1999 Busato et al.
6,073,617 A 6/2000 Busato et al.

* cited by examiner

*Primary Examiner*—Thomas N. Moulis

(57) ABSTRACT

An emission control system includes a purge valve mounted to an air intake manifold. An external wall defines an internal manifold space for distributing induction flow that has entered the manifold to be directed to the engine cylinders. A substantially cup shaped purge valve mount preferably extends from the external wall. A snap attachment assembly mounts the purge valve assembly into the mount for ease of purge valve assembly mounting and removal. The snap attachment assemblies preferably align the purge valve assembly within the mount to assure that the exhaust port communicates through exhaust aperture. To install the purge valve assembly into the mount, the purge valve assembly need only be pressed into the mount until and attachment member encounters an associated lock.

18 Claims, 2 Drawing Sheets

PURGE VALVE INTEGRATION

The present application claims priority to United States Provisional Patent Application Serial No. 60/158,093, filed Oct. 7, 1999.

BACKGROUND OF THE INVENTION

This invention relates to the integration of automotive emission control valves and intake manifolds of internal combustion engines of automotive vehicles. More particularly, it relates to the integration of a canister purge valve and an intake manifold.

Hydrocarbon emissions from automotive vehicles are subject to strict governmental regulations. It is known to associate a vapor collection system with a vehicle's fuel storage system. Fuel from a fuel tank is temporarily stored in a vapor collection canister. At times, the collected fuel vapors are purged to the engine intake manifold via a canister purge valve. There, fuel vapors are flowed into the engine where they are combusted. Precise control of purge flow is important in complying with relevant regulations and obtaining proper engine operation.

Accordingly, it is desirable to integrate a canister purge valve with an engine intake manifold to provide communication and mounting benefits. It is further desirable to provide a mounting assembly which provides for maintenance and replacement of the canister purge valve without necessitating of complex disassembly.

SUMMARY OF THE INVENTION

The emission control system according to the present invention includes a purge valve mounted to an air intake manifold. An external wall defines an internal manifold space for distributing induction flow that has entered the manifold to be directed to the engine cylinders. A substantially cup shaped purge valve mount preferably extends from the external wall.

Preferably, the mount and the external wall include a common partition area adjacent an exhaust port such that a mount wall is the intake manifold external wall are one in the same in the common partition area. The purge valve body includes an intake port and an exhaust port. The intake port extends through an intake aperture through the mount to communicate with a vapor collection canister. The exhaust port extends through an exhaust aperture through the mount and the external wall. When the purge valve assembly is open, vacuum created in the manifold interior draws fuel vapors from within the purge valve assembly, through the exhaust port through exhaust aperture and into the intake manifold. The fuel vapors are therein mixed with the induction flow and enter into the engine cylinders as part of the combustible charge.

Preferably, a snap attachment assembly mounts the purge valve assembly into the mount for ease of purge valve assembly mounting and removal. The snap attachment assemblies preferably align the purge valve assembly within the mount to assure that the exhaust port communicates through exhaust aperture.

To install the purge valve assembly into the mount, the purge valve assembly need only be pressed into the mount until and attachment member encounters an associated lock. By providing additional force, the locks are spread outward from their free state position until the locks snap back into their free state position and thereby engage the attachment member engagement surface. To remove the purge valve assembly, the locks are spread outward from their free state position, and the purge valve assembly is removed in the opposite direction.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
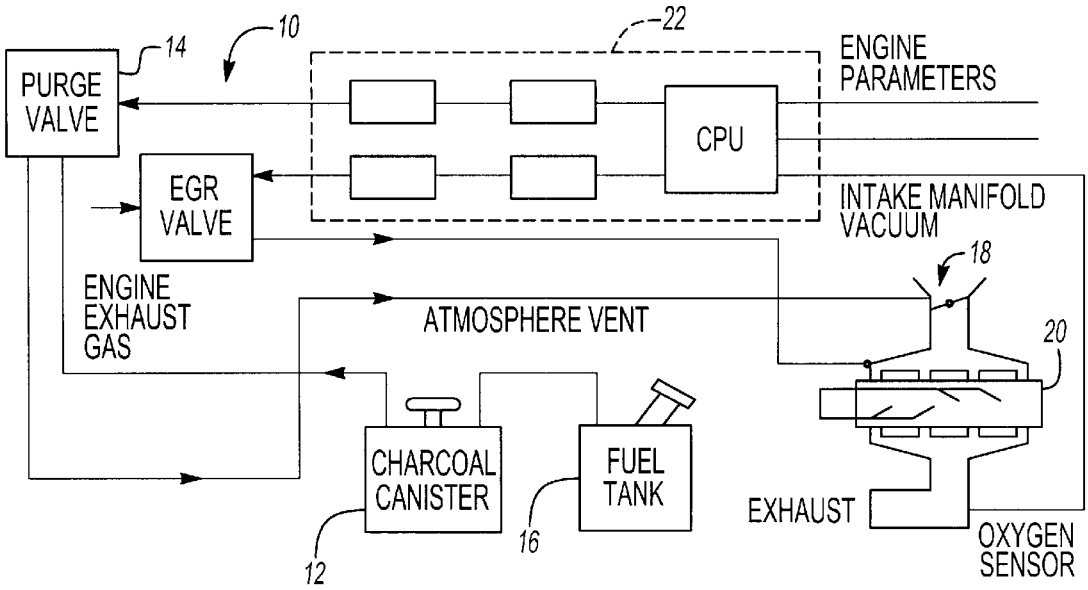
FIG. 1 is a general schematic view of a vehicle emission control system according to the present invention.

FIG. 1 illustrates an emission control system 10 for a vehicle. The system 10 generally includes a vapor collection canister (charcoal canister) 12 and an electric-operated fuel vapor purge valve assembly 14 connected in series between a fuel tank 16 and an intake manifold 18 of an engine 20. A controller 22 that receives various input signals, including various engine operating parameter signals, supplies a purge control output signal for operating valve 14 by processing certain of the various input signals in accordance with certain program algorithms. Being schematic in nature, FIG. 1 illustrates valve 14 apart from manifold 18, although valve 14 is mounted to the manifold 18 as illustrated n FIG. 2.

Figure 2:
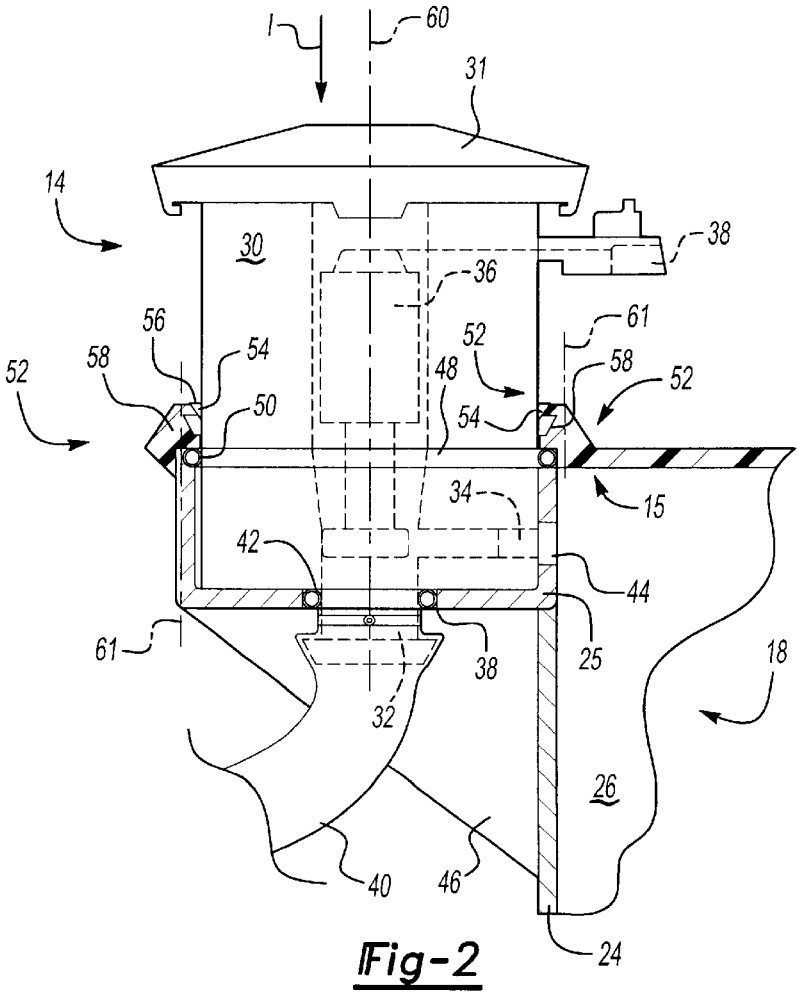
FIG. 2 is a sectional view of a purge valve assembly and integral intake manifold.

Referring to FIG. 2, a cross-sectional view through a portion of the purge valve assembly 14 mounted adjacent the intake manifold 18. Manifold 18 is preferably fabricated from a non metallic material such as glass filled nylon, PET, LCP, PPC, PBT or various others. An external wall 24 defines an internal manifold space 26 for distributing induction flow that has entered the manifold to be directed to the engine cylinders. The entering induction flow may be air that has passed through a throttle body, and the manifold may also mount electric-operated fuel injectors (not shown) proximate inlet valve mechanisms at each engine cylinder.

A substantially cup shaped purge valve mount 28 preferably extends from the external wall 24. Preferably, the purge valve mount 28 is mounted proximate a corner area 15 of the manifold 18. That is, the substantially cup shaped purge valve mount 28 extends in a cantilever manner externally from the manifold 18. The purge valve assembly 14 preferably includes a body 30 and a head 31 as is well known. It should be understood that a cup shaped mount is illustrated in the disclosed embodiment with regard to the cylinder shaped purge valve assembly 14 and that other mounts which correspond to other purge valve shapes will also benefit from the present invention.

The purge valve body 30 includes an intake port 32 and an exhaust port 34. Intake port 32 and exhaust port 34 are preferably selectively operated by a solenoid (illustrated schematically at 36) or the like. Solenoid 36 communicates with the controller 22 (FIG. 1) through a terminal 38.

The intake port 32 preferably extends through an intake aperture 38 through the mount 28. Intake port 32 communicates with the vapor collection canister 12 (FIG. 1) through a line 40. Preferably, a seal 42 such as an O-ring is fitted within the intake aperture 38 such that the seal 38 is under compression between the intake port 32 and the intake aperture 38 to assure an air-tight fit.

The exhaust port 34 preferably extends through an exhaust aperture 44 through the mount 28 and the external wall 24. When purge valve assembly 14 is open, vacuum created in the manifold interior 26 draws fuel vapors from within the purge valve assembly 14, through the exhaust port 34 through exhaust aperture 44 and into the intake manifold 18. The fuel vapors are therein mixed with the induction flow and enter into the engine cylinders as part of the combustible charge.

Figure 2A:
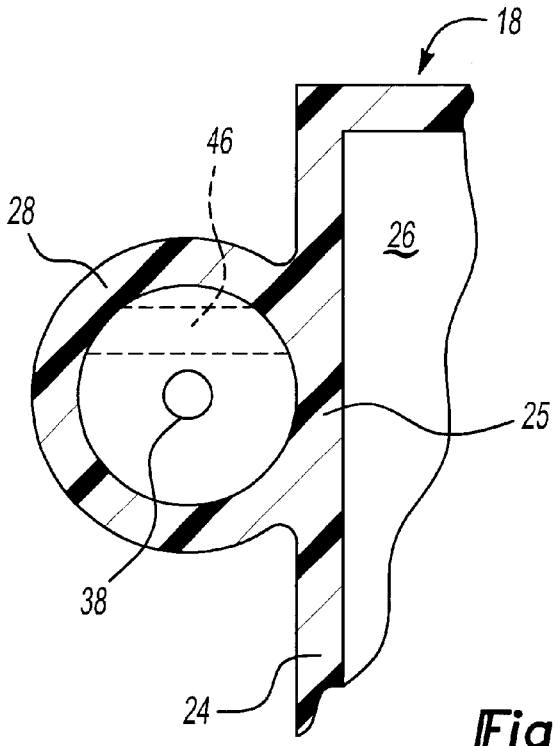
FIG. 2A is a top view of the purge valve assembly and integral intake manifold illustrated in FIG. 2.

Preferably, the mount 28 and the external wall 24 include a common partition area 25 adjacent the exhaust port 34 such that a mount wall 28 is the intake manifold 18 external wall 24 are one in the same in the common partition area 25 (also illustrated in FIG. 2A). As the mount 28 is cup-shaped, and the external wall 24 defines a plane, the common partition area 25 defines a tangential relationship. A support rib 46 preferably extends from the external wall 24 to further support the mount 28. Although a substantially cup shaped mount 28 and a substantially triangular support mount 46 are illustrated, it should be understood that other purge valve mounting and support arrangements will benefit from the present invention.

The purge valve body 30 includes a groove 48 to receive a seal 50 such as an O-ring. When the body 30 is mounted into the mount 28, the seal 50 is under compression between the body 30 and the mount 28 to further assure an air-tight fit.

Preferably, an attachment assembly 52 mounts the purge valve assembly 14 into the mount 28 for ease of purge valve assembly 14 mounting and removal. The purge valve body 30 preferably includes an integral substantially ramp shaped attachment member 54 having an engagement surface 56. Resilient locks 58 preferably extend from the manifold 18 external wall 24 and the mount 28 along a lock axis 61 defined substantially parallel to a primary axis 60 defined by the body 30. The snap attachment assemblies 52 preferably align the purge valve assembly 14 within the mount 28 to assure that the exhaust port 34 communicates through exhaust aperture 44. Additional alignment and anti-rotation features, such as a slot and key can be further incorporated into the purge valve assembly 14.

Figure 2B:
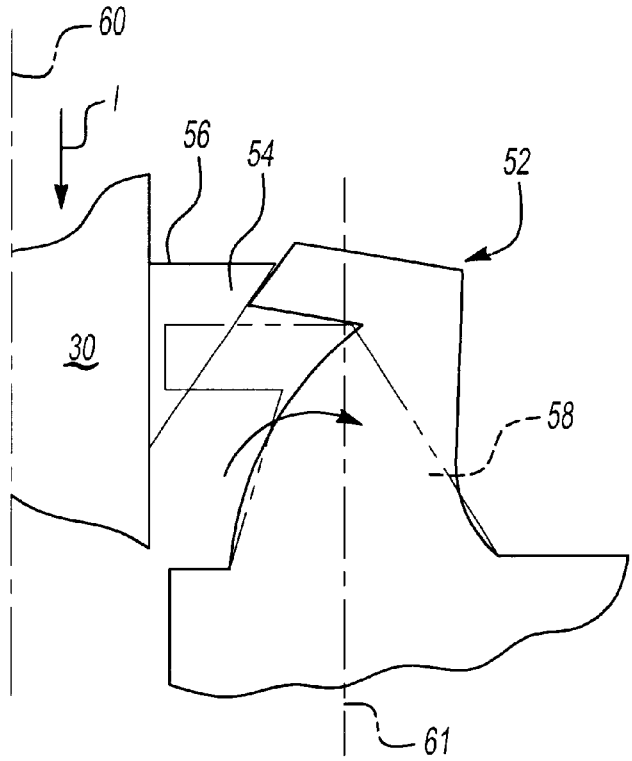
FIG. 2B is an expanded view of the snap attachment assembly illustrated in FIG. 2.

To install the purge valve assembly 14 into the mount 28, the purge valve assembly 14 need only be pressed into the mount 28 (illustrated by arrow I) along a primary axis 60. The purge valve assembly 14 is pressed in the direction of arrow I along the primary axis 60 until each attachment member 54 encounters an associated lock 58. By providing additional force in the direction of arrow I, the locks 58 are spread outward from their free state position (shown in phantom; FIG. 2B). Because the attachment members 54 are preferably ramped, minimal additional force is required to force the locks 58 past the attachment members 54. Further force in the direction of arrow I allows the locks 58 to pass by the attachment members 54. The locks 58 can then snap back into their free state position and thereby engage the attachment member 54 engagement surface 56. To remove the purge valve assembly 14, the locks 58 are spread outward from their free state position (FIG. 2B), and the purge valve assembly 14 is removed in the opposite direction (opposite arrow I).

The present invention therefore provides an integrated canister purge valve having a mounting assembly which provides for maintenance and replacement of the canister purge valve without complex disassembly.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A vehicle intake manifold assembly comprising:

an air intake manifold having an external wall proximate a corner area of said air intake manifold; and a purge valve mount extends from said external wall at a common partition area, said purge valve mount having a resilient lock to retain a purge valve assembly in said purge valve mount.

2. The vehicle intake manifold assembly as recited in claim 1, wherein the purge valve assembly includes a purge valve body having an attachment member engageable with said resilient lock to retain said purge valve body in said purge valve mount.

3. The vehicle intake manifold assembly as recited in claim 2, wherein said attachment member includes a substantially ramped member.

4. The vehicle intake manifold assembly as recited in claim 1, wherein said a purge valve mount includes a substantially cup-shaped member.

5. A vehicle intake manifold assembly comprising:

an air intake manifold having an external wall proximate a corner area of said air intake manifold;

a substantially cup-shaped purge valve mount extends from said external wall at a common partition area; and a purge valve body defining a primary axis and having an attachment member, said purge valve body insertable into said purge valve mount, a resilient lock extending form said purge valve mount defining a lock axis substantially parallel to said primary axis, said resilient lock engageable with said attachment member to retain said purge valve body in said purge valve mount.

6. The vehicle intake manifold assembly as recited in claim 5, wherein said a purge valve mount includes a substantially cup-shaped member.

7. The vehicle intake manifold assembly as recited in claim 5, wherein said a purge valve body includes an intake port and an exhaust port.

8. The vehicle intake manifold assembly as recited in claim 7, wherein said purge valve mount includes an intake aperture corresponding to said intake port and said exhaust aperture corresponding to said exhaust port.

9. The vehicle intake manifold assembly as recited in claim 8, wherein said exhaust aperture passes through said common partition area.

10. The vehicle intake manifold assembly as recited in claim 5, further comprising support rib attached between said external wall and said purge valve mount.

11. A vehicle intake manifold assembly comprising:

an air intake manifold having an external wall proximate a corner area of said air intake manifold;

a substantially cup shaped purge valve mount extends from said external wall at a common partition area in a tangential relationship; and a purge valve body defining a primary axis and having an attachment member, said purge valve body insertable into said purge valve mount, a resilient lock extending form said purge valve mount defining a lock axis substantially parallel to said primary axis, said resilient lock engageable with said attachment member to retain said purge valve body in said purge valve mount.

12. The vehicle intake manifold assembly as recited in claim 1, further comprising a support rib extending from said external wall to support said purge valve mount.

13. The vehicle intake manifold assembly as recited in claim 1, further comprising an intake port extending from said a purge valve assembly, said intake port located parallel to said external wall and located external from said air intake manifold.

14. The vehicle intake manifold assembly as recited in claim 1, further comprising an intake exhaust port extending through said external wall an in communication with an interior of said air intake manifold, said exhaust port.

15. The vehicle intake manifold assembly as recited in claim 1, further comprising a support rib extending from said external wall to support said purge valve mount.

16. The vehicle intake manifold assembly as recited in claim 1, wherein said purge valve mount extends from said external wall in a substantially cantilevered arrangement.

17. The vehicle intake manifold assembly as recited in claim 5, wherein said purge valve mount extends from said external wall in a substantially cantilevered arrangement.

18. The vehicle intake manifold assembly as recited in claim 11, wherein said purge valve mount extends from said external wall in a substantially cantilevered arrangement.

* * * * *